US007677524B2

(12) United States Patent
Brooke

(10) Patent No.: US 7,677,524 B2
(45) Date of Patent: Mar. 16, 2010

(54) SELF-STABILIZING SUPPORT ASSEMBLY FOR AN ITEM FURNITURE

(75) Inventor: Rory Brooke, Meyerton (ZA)

(73) Assignee: Hedera AB, Lund (SE)

( * ) Notice: Subject to any disclaimer, the term of this patent is extended or adjusted under 35 U.S.C. 154(b) by 584 days.

(21) Appl. No.: 10/575,198

(22) PCT Filed: Oct. 7, 2004

(86) PCT No.: PCT/IB2004/003270

§ 371 (c)(1),
(2), (4) Date: Feb. 27, 2007

(87) PCT Pub. No.: WO2005/034680

PCT Pub. Date: Apr. 21, 2005

(65) Prior Publication Data

US 2007/0252053 A1 Nov. 1, 2007

(30) Foreign Application Priority Data

Oct. 10, 2003 (ZA) ..... 2003/7931

(51) Int. Cl.
*F16M 13/00* (2006.01)

(52) U.S. Cl. ..... 248/582; 248/592; 248/431; 248/188.3

(58) Field of Classification Search ..... 248/582, 248/592, 593, 599, 431, 188.1, 188.2, 188.3, 248/188.7; 108/142
See application file for complete search history.

(56) References Cited

U.S. PATENT DOCUMENTS 2,467,175 A * 4/1949 Woodward ..... 248/188.3
3,185,423 A 5/1965 Jones, III
3,768,766 A 10/1973 Bain
4,406,437 A * 9/1983 Wright ..... 248/529
4,712,758 A * 12/1987 Cuschera ..... 248/188.7
5,490,648 A 2/1996 Cullen
5,690,303 A 11/1997 Winters (Continued)

FOREIGN PATENT DOCUMENTS

GB 1 315 833 5/1973

(Continued)

*Primary Examiner*—J. Allen Shriver, II
*Assistant Examiner*—Bradley H Duckworth
(74) *Attorney, Agent, or Firm*—Ladas and Parry LLP

(57) ABSTRACT

The invention relates to a self-stabilizing support assembly (14) for an item of furniture, such as a table, stool or chair. The assembly includes a support structure (16) for connection at an upper end thereof to an upper portion of an item of furniture. The support structure has a first pair of feet (50) at a lower end (22) thereof. An elongated guides pin (38) projects from a lower end of the support structure. A displaceable support member (30), which has a second pair of feet (32), is provided with a housing (36) defining a guide passage, in which guide passage the guide pin is longitudinally slidably received. The housing is constructed such that a cross-sectional area of the guide passage is adjustable, to permit dimensioning of the guide passage relative to the guide pin such that automatic frictional engagement of the guide pin with walls of the housing defining the guide passage occurs in response to pivoting of the displaceable support member about a pivot axis transverse to the housing, to anchor the displaceable support member frictionally against sliding displacement relative to the guide pin.

24 Claims, 6 Drawing Sheets

U.S. PATENT DOCUMENTS 5,899,422 A 5/1999 Eke
6,019,154 A * 2/2000 Ma et al. ..... 156/580
6,155,743 A * 12/2000 Chen ..... 403/374.1
6,209,465 B1 * 4/2001 Brooks ..... 108/150
6,578,804 B2 * 6/2003 Lin et al. ..... 248/188.7
2008/0087777 A1 * 4/2008 Christian et al. ..... 248/188.8

FOREIGN PATENT DOCUMENTS

WO 00/59344 10/2000

* cited by examiner

SELF-STABILIZING SUPPORT ASSEMBLY FOR AN ITEM FURNITURE

THIS INVENTION relates to furniture. In particular, the invention relates to a support assembly for an item of furniture, and to a self-stabilizing arrangement for an item of furniture. It relates also to an item of furniture.

The invention is expected to be used in the context of tables, stools and chairs, having substantially operatively horizontal tops or seat portions which are supported above a surface on which the table, stool or chair is operatively located. For purposes of this specification, the term "upper portion" is to be understood as including a table top and a seat portion of a stool or chair.

In accordance with one aspect of the invention there is provided a support assembly for an item of furniture, which support assembly includes:

an elongated support structure for connection at an operatively upper end thereof to an upper portion of an item of furniture, the support structure having a first pair of feet at or adjacent an operatively lower end thereof;

an elongated guide formation fast with the support structure and extending lengthwise relative to the support structure;

a displaceable support member which has a second pair of feet at or adjacent an operatively lower end thereof, the displaceable support member being arranged relative to the support structure so that a line drawn between the feet of the first pair is transverse to a line drawn between the feet of the second pair, the displaceable support member also being provided with an elongated guided formation complementary to and longitudinally slidably engaged with the guide formation, so that the displaceable support member is slidably displaceable along a rectilinear guide path which is transverse to the lines drawn between both the pairs of feet, with one of the guide formation and the guided formation being in the form of a guide pin, the other one of the guide formation and the guided formation being in the form of a housing defining a guide passage within which the guide pin is longitudinally slidably received, the housing being constructed such that a cross-sectional area of the guide passage is adjustable, to permit dimensioning of the guide passage relative to the guide pin such that automatic frictional engagement of the guide pin with walls of the housing defining the guide passage occurs in response to pivoting of the displaceable support member about a pivot axis which is transverse to the displaceable support member's guide path, to anchor the displaceable support member frictionally against sliding displacement relative to the support structure.

The housing may be provided with a longitudinally extending slit and with an adjustment arrangement for adjusting the width of the slit, to permit said adjustability of the cross-sectional area of the guide passage.

The adjustment arrangement may comprise two passage defining formations and a bolt-and-nut assembly, one passage defining formation being located on each side of the slit, the passages defined by the formations being substantially aligned and extending transverse relative to a longitudinal axis of the guide passage, with the bolt of the assembly being received in and extending through the passages, such that the passage defining formations are held captive between the head of the bolt and the nut of the assembly, and adjustment of the width of the slit is effected by threading of the nut on the bolt.

The guide passage may be of circular cross-section, the guide pin being circular cylindrical.

The guide formation may be constituted by the guide pin, the guide pin projecting operatively downwardly from the operatively lower end of the support structure, and the guided formation being constituted by the guide passage defined by the housing, with the housing being centrally located with respect to the displaceable support member.

The support structure may comprise an elongated operatively upright post and a spider formation connected to an operatively lower end of the post, the spider formation comprising four radially outwardly projecting spokes which are equiangularly spaced about a longitudinal axis of the post, each spoke being channel-shaped and opening operatively downwardly, with the guide pin engaging the spider formation and projecting centrally operatively downwardly therefrom.

One pair of aligned spokes may be provided with the first pair of feet, the feet of the first pair respectively being provided at ends of the spokes of said one pair of spokes.

The displaceable support member may comprise an arm which is received in the channel defined by the other pair of aligned spokes and extending lengthwise therealong, the feet of the second pair of feet respectively being provided at the ends of the arm.

The arm and the housing may be integrally formed. Instead, the arm may be constituted by two elongated members which are secured to the housing to project radially outwardly therefrom in opposite directions.

The support assembly may include at least one urging member urging the arm operatively downwardly away from the support structure. The support assembly may include two urging members which are equally spaced on opposite sides of the guide formation, each urging member being in the form of a compressed spring located in the channel defined by said other pair of spokes and acting between the spokes and the arm.

The support assembly may also include a securing formation fast with an operatively lower end of the guide pin, which securing formation together with the spider formation holds the housing captive on the guide pin.

The feet of the second pair may be spaced at equal distances from a longitudinal axis of the guide formation. Further, the feet of the first pair may be spaced the same distance from a longitudinal axis of the guide formation as the feet of the second pair are spaced from the longitudinal axis of the guide formation.

The line drawn between the first pair of feet and the line drawn between the second pair of feet may be at right angles to each other.

The support assembly may further include sealing means sealing the guide pin off from the environment.

In accordance with another aspect of the invention there is provided a self-stabilizing arrangement for an item of furniture, which arrangement includes:

an elongated first support component having at each end a foot projecting in the same direction;

an elongated guide formation fast with the first support component; and an elongated second support component having at each end a foot projecting in the same direction as the feet of the first support component, the second support component including an elongated guided formation complementary to and longitudinally slidably engaged with the guide formation, one of the guide formation and the guided formation being in the form of a guide pin, the other one of the guide formation and the guided formation being in the form of a guide passage defined by a housing fast with the associated one of the first and the second support components, within which guide passage the guide pin is longitudinally slidably received, such that the second support component is slidably displaceable relative to the first support component, with the housing being constructed such that a cross-sectional area of the guide passage is adjustable.

The housing may be provided with a longitudinally extending slit and with an adjustment arrangement for adjusting the width of the slit, to permit said adjustability of the cross-sectional are of the guide passage.

The adjustment arrangement may comprise two passage defining formations and a bolt-and-nut assembly, one passage defining formation being located on each side of the slit, the passages defined by the formations being substantially aligned and extending transverse to a longitudinal axis of the guide passage, with the bolt of the assembly being received in and extending through the passages, such that the passage defining formations are held captive between the head of the bolt and the nut of the assembly, and adjustment of the width of the slit is effected by threading of the nut on the bolt.

The guide formation may be constituted by the guide pin, the guide pin being centrally fast with the first support component and projecting in the same direction as the feet, the guided formation being constituted by the guide passage defined by the housing, the housing being integrally formed with and centrally located with respect to the second support component.

The first support component and the second support component may be orthogonal.

The arrangement may include a locating arrangement, the locating arrangement keeping the first and the second support components in a predetermined relative configuration.

The locating arrangement may include a pair of longitudinally aligned spokes fast with the first support component and projecting radially outwardly therefrom, such that the spokes and the first support component are orthogonal, the spokes being shaped to define a locating channel opening in the same direction as the direction in which the feet and the pin project, in which locating channel the second support component is located.

The guide formation and the guided formation may be shaped and dimensioned such that there is limited clearance, which clearance is adjustable on account of the adjustability of the cross-sectional area of the guide passage, between the guide pin and a wall of the housing defining the guide passage, so that automatic frictional locking of the second support component relative to the first support component occurs when a nett moment about an axis transverse to a longitudinal axis of the guide pin is exerted on the second support component.

The arrangement may include at least one urging member urging the second support component away from the first support component in the same direction in which the feet project. The arrangement may include two urging members which are equally spaced on opposite sides of the guide formation, each urging member being in the form of a compressed spring located in the channel defined by said other pair of spokes and acting between the spokes and the second support component.

The arrangement may include a securing formation for securing it, in use, to a support structure of an item of furniture.

The arrangement may include sealing means sealing the guide pin off from the environment.

The arrangement may include a securing formation fast with the guide pin, which securing formation serves to hold the guided formation captive on the guide pin.

In accordance with yet another aspect of the invention there is provided an item of furniture which includes a support assembly as hereinbefore described, and an upper portion of an item of furniture mounted on the support assembly.

The item of furniture may be a table, the upper portion of the item of furniture being a table top. Instead, the item of furniture may be a stool or a chair, the upper portion of the item of furniture being a seat portion of the stool or chair.

In accordance with still another aspect of the invention there is provided an item of furniture which includes a self-stabilizing arrangement as hereinbefore described, and an upper portion of an item of furniture fast with the first support component thereof.

The item of furniture may be a table, the upper portion of the item of furniture being a table top. Instead, the item of furniture may be a stool or a chair, the upper portion of the item of furniture being a seat portion of the stool or chair.

The invention will now be further described, by way of example, with reference to the accompanying schematic drawings, in which.

Figure 1:
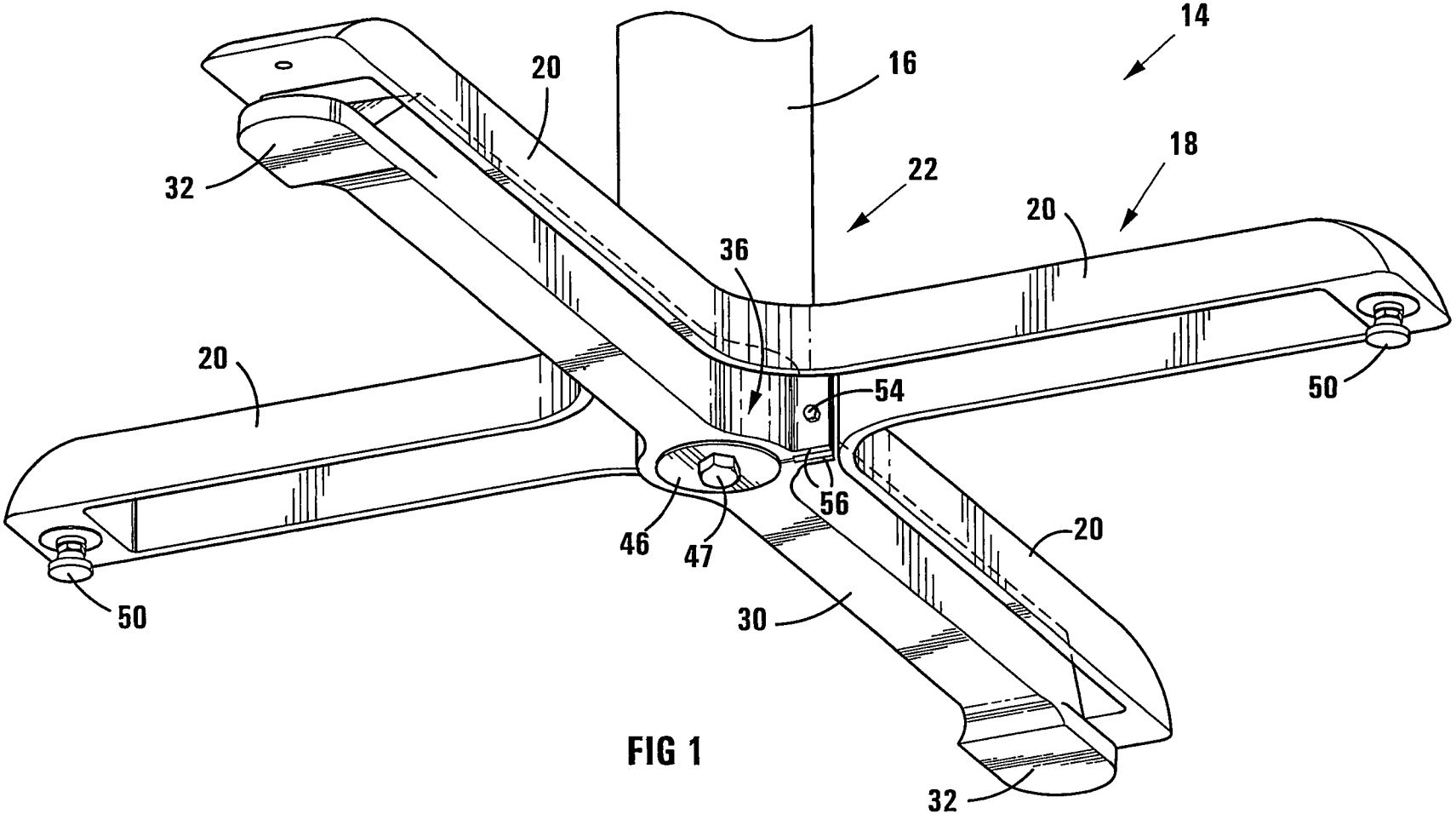
FIG. 1 shows a three-dimensional view of a portion of a support assembly in accordance with the invention, a lower guide pin seal of the assembly being omitted.
Figure 2:
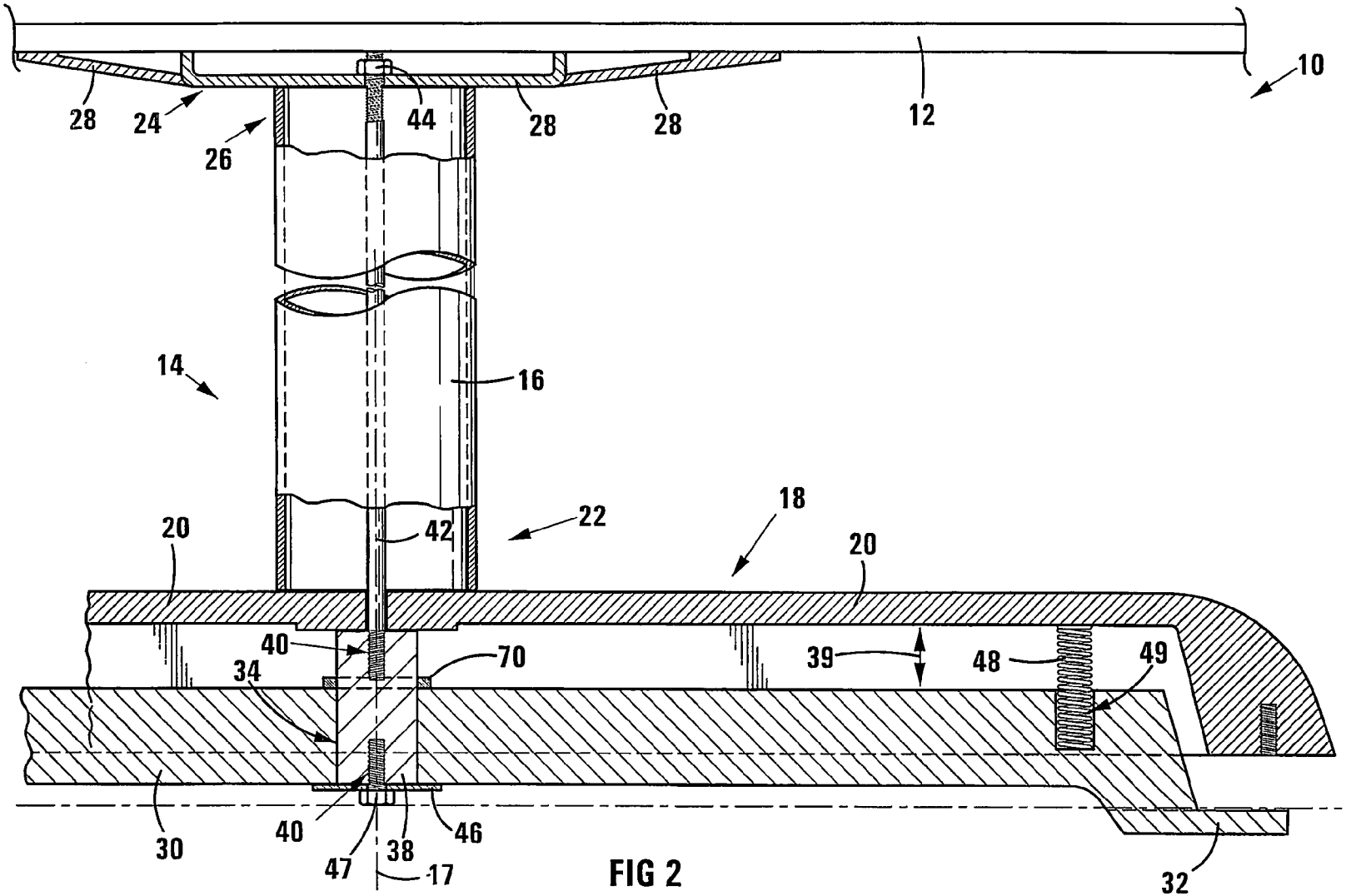
FIG. 2 shows, fragmentarily and on an enlarged scale, a sectional side elevation of a table in accordance with the invention, the table including the support assembly shown in FIG. 1, the lower guide pin seal also being omitted in this figure.
Figure 5:
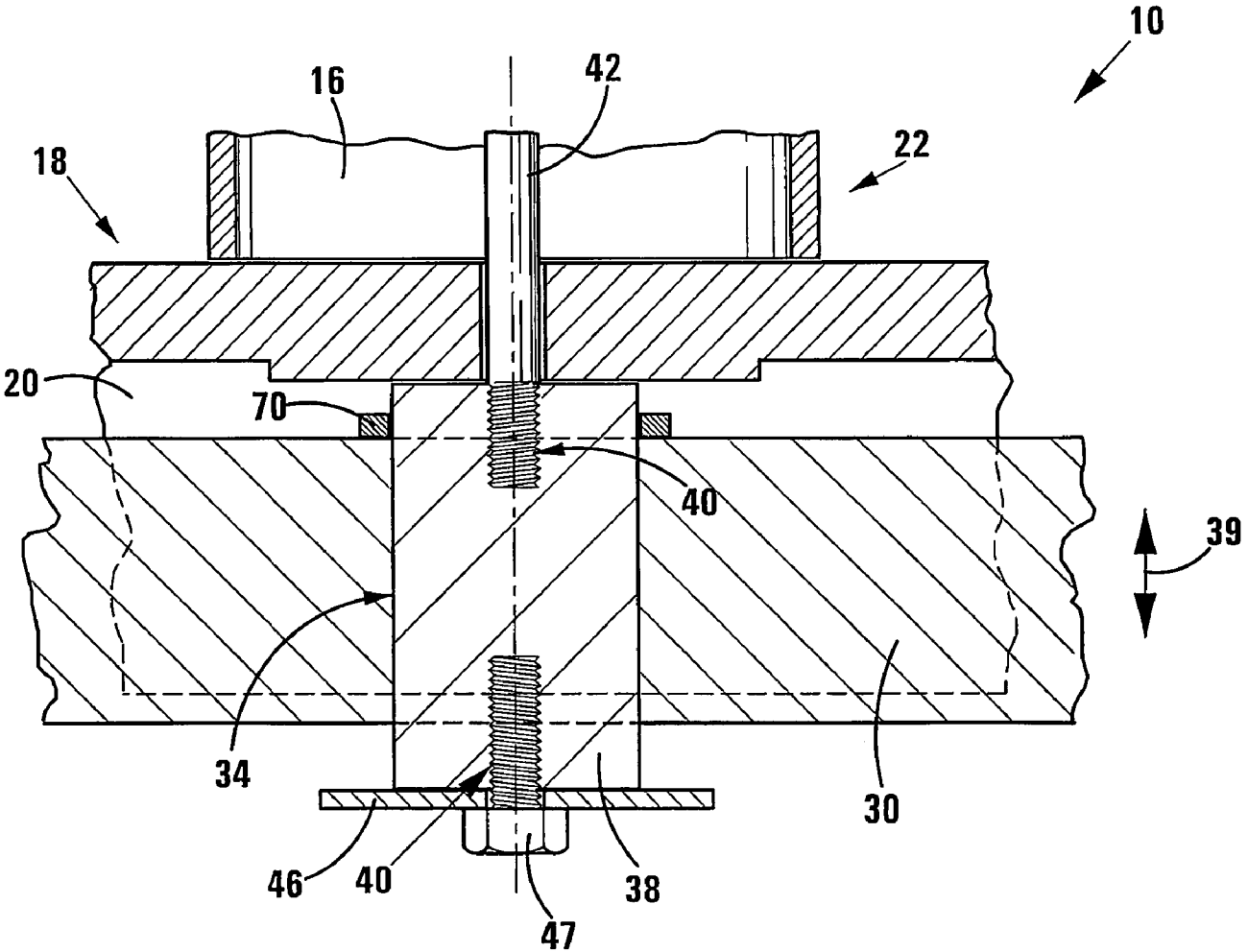
Figure 6:
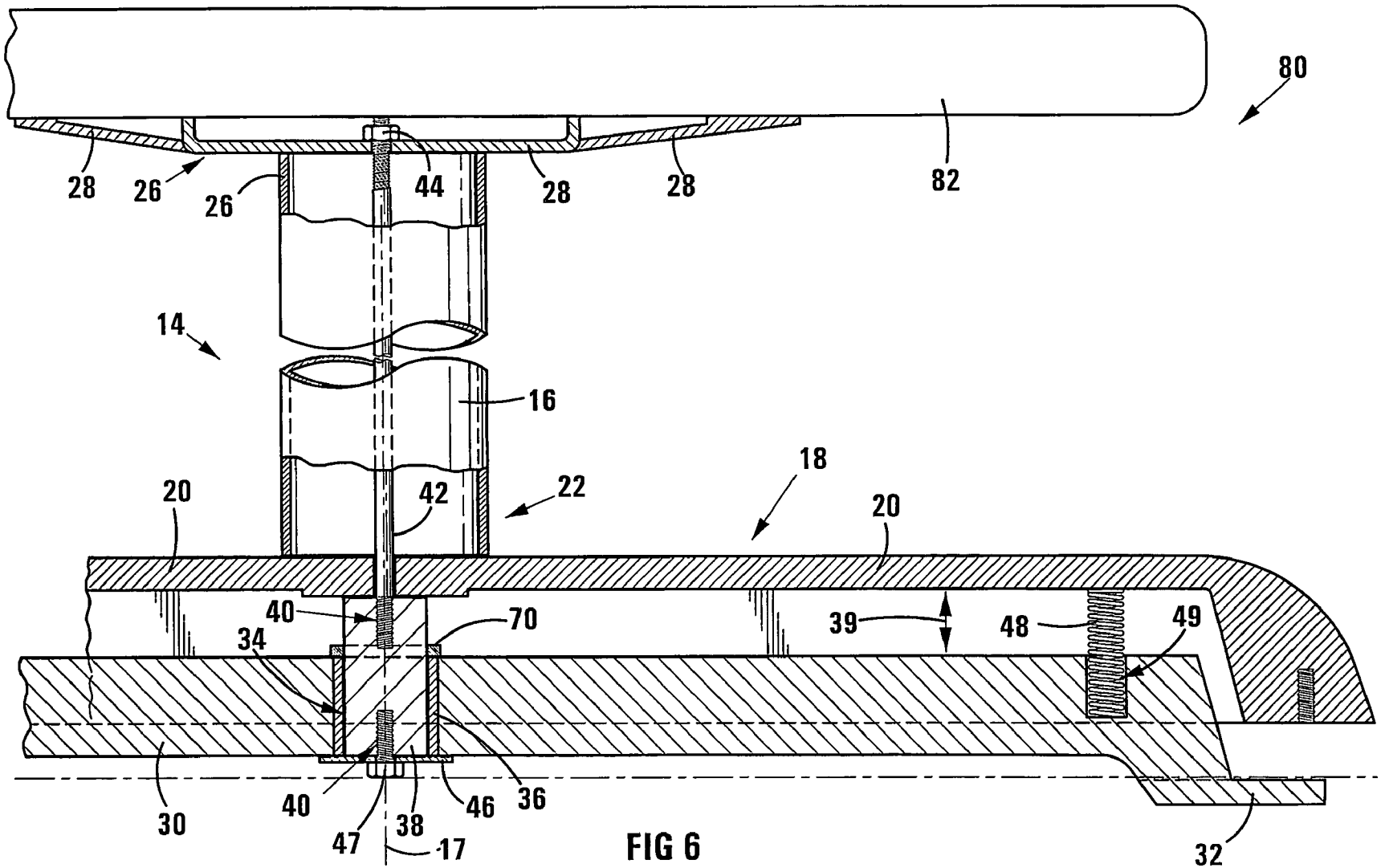

FIG. 5 shows, on an enlarged scale, a portion of the support assembly shown in FIG. 2, with a displaceable support member thereof being displaced; and FIG. 6 shows, fragmentarily and on an enlarged scale, a sectional side elevation of a stool or chair in accordance with the invention, the stool or chair including the support assembly shown in FIG. 1, the lower guide pin seal also being omitted in this figure.

Referring to FIG. 2 of the drawings, reference numeral 10 generally indicates a portion of a table in accordance with the invention. The table 10 comprises an upper portion in the form of a table top 12 (not sectioned) mounted on a support assembly 14 in accordance with the invention. The support assembly 14, in turn, comprises an operatively upright elongated hollow post 16 and a spider formation 18 which includes four radially projecting equiangularly spaced spokes 20 connected to a lower end 22 of the post 16. The spider formation 18 is shaped such that a plane defined by the spokes 20 is normal to a longitudinal axis 17 of the post 16. For clarity of illustration, the spokes 20 are shown slightly wider in FIG. 4.

A mounting member 24 (FIG. 2) is connected to an upper end 26 of the post 16, the mounting member 24 comprising a series of four equiangularly spaced mounting flanges 28. Each mounting flange 28 has a pair of apertures (not shown) therethrough, through which apertures screws (also not shown) are passed, the screws being screwed into the table top 12, to mount the table top 12 on the support assembly 14.

Each spoke 20 is channel-shaped and opens downwardly, thus having an inverted U-shape in cross-sectional profile. A displaceable support member in the form of an elongated displaceable arm 30 is received in one pair of aligned spokes 20, extending lengthwise along the said pair of spokes 20. The displaceable arm 30 is of mild steel construction, being in the form of a casting. The displaceable arm 30 provides a downwardly projecting foot 32 at each end thereof. The spider formation 18 forms a locating arrangement for keeping the displaceable arm 30 perpendicular to the other pair of spokes 20 by restricting pivotal displacement of the displaceable leg 30 about the longitudinal axis 17 of the post 16.

The support assembly 14 includes a housing 36 which is fast with and integrally formed with the arm 30, being located centrally with respect to the arm 30. Although the arm 30 and the housing 36 are illustrated and described as being of one-piece construction, it will be appreciated that in other examples, not shown, the arm 30 can be constituted by two elongated members which are secured, typically by welding, to the housing 36. The housing 36 defines a substantially circular cylindrical guide passage 34. A guide member in the form of a circular cylindrical guide pin 38 projects, via the spider formation 18, downwardly from the lower end 22 of the post 16, the guide pin 38 being coaxial with the with post 16. The guide pin 38 is longitudinally slidably received in the guide passage 34, so that the housing 36 is displaceable along the guide pin 38 in directions indicated by arrow 39 (FIG. 5). The guide pin 38 constitutes a guide formation, the housing 36 constituting a guided formation.

The pin 38 has a central blind screw-threaded bore 40 at each of its ends, the bore 40 closest to the post 16 being screw-threadingly engaged by a tightening rod 42 which extends lengthwise along the hollow interior of the post 16, being coaxial with the post 16. The tightening rod 42 passes, at its one end, through a complementary opening in the spider formation 18, and at its other end, through a complementary opening in the mounting member 24, a tightening nut 44 being screw-threadingly engaged with the upper end of the rod 42. Thus, the pin 38 doubles as a nut, so that tightening of the pin 38 places the rod 42 under tension, clamping the mounting member 24 to the upper end 26 of the post, and clamping the spider formation 18 to the lower end 22 of the post 16.

A stop washer 46 is connected to the lower end of the pin 38 by a bolt 47 which is screwingly received in the screw-threaded bore 40 at the lower end of the pin 38, the washer 46 having a diameter which is greater than the diameter of the passage 34, so that the washer 46 limits sliding displacement of the arm 30 along the pin 38 by abutment of the arm 30 against the washer 46. The washer 46 and the bolt 47 thus form a securing formation, which securing formation together with the spider formation 18 holds the housing 36 captive on the guide pin 38. Although not shown as such, the passage 34 can be stepped, to be wider at its bottom end, with an internal shoulder against which the washer 46 bears, such that the washer 46 and the head of the bolt 47 are located within the passage 34 when the arm 30 is displaced operatively downwardly away from the spider formation 18.

The support assembly 12 includes a pair of coiled springs 48 (only one of which is visible in FIG. 2) under compression, the springs 48 acting between the spokes 20 and the arm 30, to urge the arm 30 operatively downwardly away from the spider formation 18. To this end, the arm 30 is provided with two blind passages 49 (also only one of which is visible in FIG. 2) respectively receiving the respective springs 48, the springs being held captive between the arm 30 and the spokes 20. The springs 48 are constructed so that they remain under compression even when the arm 30 abuts the stopping washer 46. Although not visible in FIG. 2, the springs 48 are spaced at equal radial distances from the guide pin 38, and are diametrically opposed about the pin 38.

As can be seen in FIG. 1 of the drawings, the spokes 20 of the other pair of aligned spokes 20, i.e. the spokes 20 which extend perpendicularly to the arm 30, are each, at their outer ends, provided with an operatively downwardly projecting fixed foot 50. Said pair of spokes 20 thus forms a first support member which has a foot 50 at each end thereof. Furthermore, the spider formation is provided with a central recess or cavity defined between the spokes 20 where they meet, in which recess the guide pin 38 and the housing 36 are located. The spider formation 18 thus constitutes a locating arrangement, keeping the arm 30 perpendicular to the other pair of spokes 20 by restricting swivelling of the arm 30 about the guide pin 38.

Figure 3:
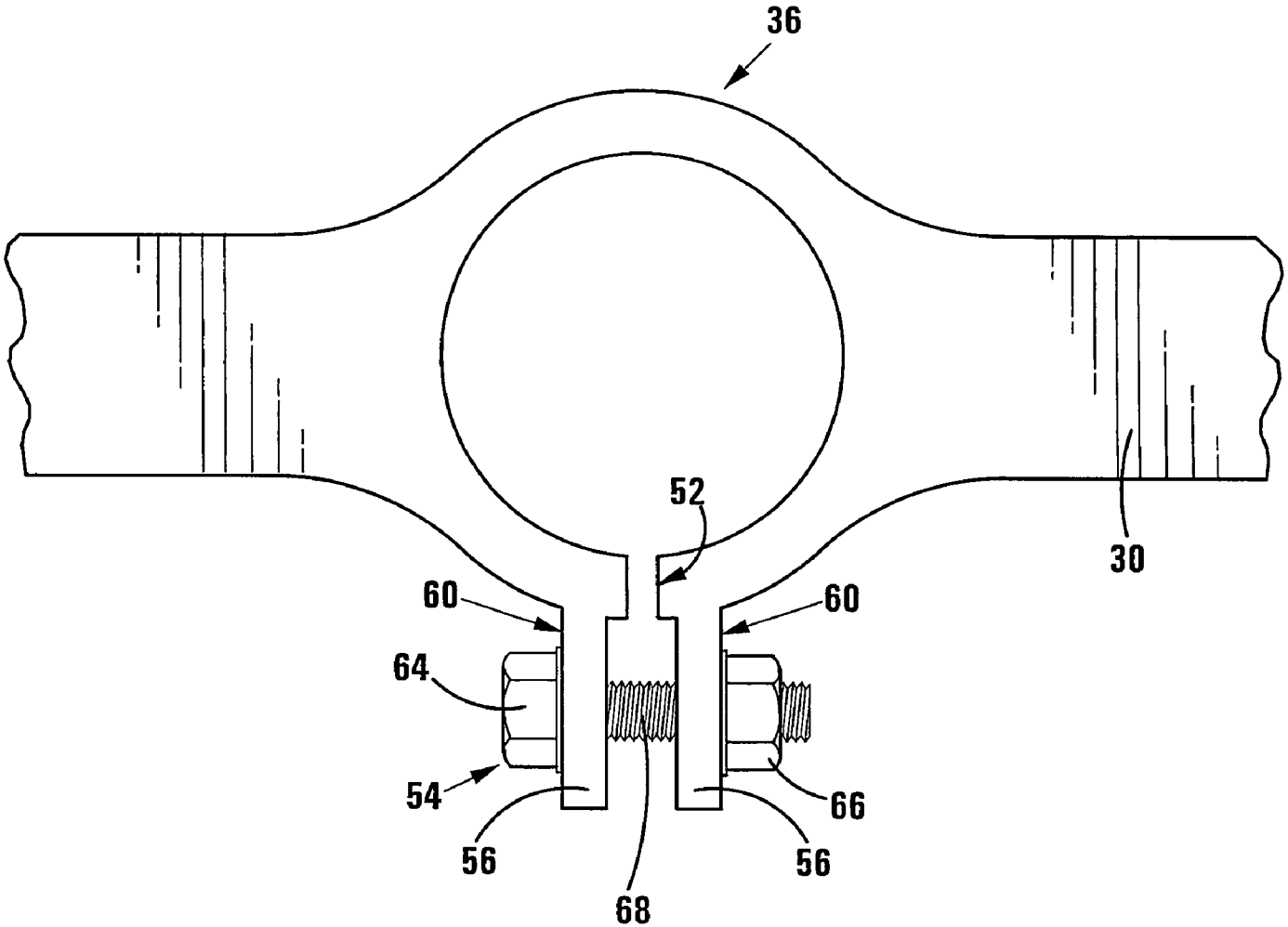
FIG. 3 shows, on a slightly enlarged scale, a top plan view of a displaceable support member of the support assembly shown in FIG. 1, the lower guide pin seal also being omitted.
Figure 4:
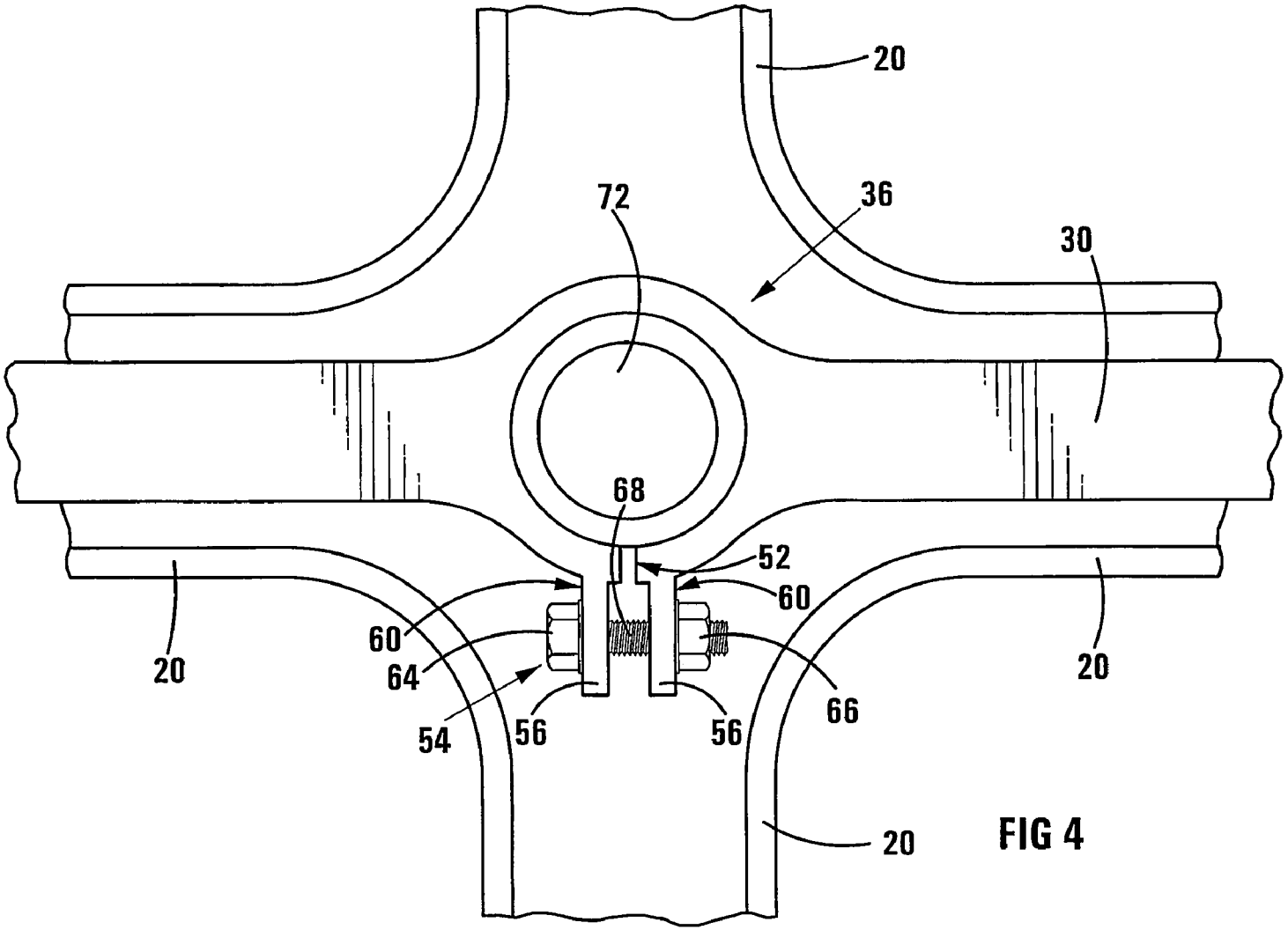
FIG. 4 shows, fragmentarily and on an enlarged scale, a bottom plan view of the table support assembly shown in FIG. 1.

Referring in particular to FIGS. 3 and 4, the housing 36 is provided with a longitudinally extending slit 52. The slit 52 extends along the full length of the housing 36, the width of the slit 52, and thus the diameter of the guide passage 34, being adjustable by an adjustment arrangement including an adjusting bolt 54. The cross-sectional area of the guide passage 34 is thus adjustable. More particularly, the housing 36 is provided with two passage defining formations 56, each providing a passage (not shown), through which passages the bolt 54 is received. The passage defining formations 56 are positioned proximate the slit 52, one on either side of the slit 52, and they extend radially outwardly from the housing 36. The formations 56 extend substantially parallel to each other, with the passages provided thereby being aligned and extending transversely relative to the lengthwise direction of the guide passage 34. The adjusting bolt 54 is, as mentioned received through the passages, a head 64 (FIG. 4) of the bolt 54 being positioned against an operatively outer surface 60 of one of the formations 56, and a nut 66 (FIG. 4), threaded onto the bolt 54, being positioned on the outer surface 60 of the other formation 56. Washers are located between the head 64 of the bolt 54 and the associated formation 56 and between the nut 66 and its associated formation 56. The formations 56 are thus held captive between the head 64 of the bolt 54 and the nut 66, so that tightening of the nut 66 on a shaft 68 (FIG. 4) of the bolt 54 causes the breadth or width of the slit 52 to narrow and the cross-sectional area of the guide passage 34 to decrease. Naturally, the reverse also applies.

Although not shown as such, the guide passage 34 can be lined by a bush or sleeve, or even more than one longitudinally spaced bushes or sleeves, of a relatively more wear-resistant material than the material from which the housing 36 is constructed, to resist wear as the housing 36 slides along the guide pin 38. Naturally such bush or sleeve will be constructed to accommodate adjustment of the cross-sectional area of the guide passage 34.

The guide pin 38 is lubricated and the support assembly 14 is provided with an upper rubber guide pin seal 70 (shown in concept in FIGS. 2 and 5 only) and a lower rubber guide pin seal 72 (shown in concept in FIG. 4), for sealing the guide pin 38 from the environment. The seal 70, although not shown as such can, if desired, be in the form of a longitudinally extensible and retractable seal which accommodates relative movement of the housing 36 to the guide pin 38. The seal 72, in turn, is in the form of a boot received over the stop washer 46 and the bolt 47. Naturally, the boot can also be longitudinally extensible and retractable.

The diameter of the guide passage 34 is adjusted, by means of the adjustment arrangement, such that there is limited clearance between the guide pin 38 and walls of the housing 36 defining the guide passage 34, so that there is frictional locking of the displaceable arm 30 on the guide pin 38 when a couple, or a nett moment about an axis transverse to a longitudinal axis of the guide pin 38 is exerted on the arm 30, which typically happens when the table 10 is located on an uneven surface. The arm 30 is thus only slidably displaceable along the guide passage 34 when there is substantially no nett moment acting on the arm 30 about an axis coaxial with a line drawn between the two fixed feet 50.

The support assembly 14 without the post 16 thus defines a self-stabilizing arrangement in accordance with the invention.

In use, the support assembly 14 supports the table top 12 on a support surface such as the ground (not shown). When the ground surface is uneven, the support assembly 14 is automatically operable to displace the arm 30 relative to the spider formation 18 such that all four feet 50, 32 bear against the support surface.

When, for instance, the ground is uneven such that both of the fixed feet 50 bear against the ground, but only one of the displaceable feet 32 at a time touches the ground, the table 10 will tend to rock by pivoting of the spider formation 18 about the axis aligned with a line interconnecting the fixed feet 50. During such rocking, the displaceable arm 30 is urged downwardly by the springs 48 when both feet 32 are clear of the ground, i.e. when no external forces are exerted on the feet 32, the arm 30, via the housing 36, being automatically locked in position on the guide pin 38 when either of the feet 32 abut against the ground. The displaceable arm 30 thus automatically finds a position where both its feet 32, as well as the fixed feet 50 bear against the ground.

In instances where the ground is uneven such that both the displaceable feet 32, but only one of the fixed feet 50, bear against the ground, the arm 30 is displaced upwardly along the guide pin 38 until both the fixed feet 50 bear against the ground surface. It will be appreciated that, in order for the arm 30 to be in equilibrium, upward forces exerted by the ground on the displaceable feet 32 must be equal to each other. This is because the feet 32 are equally spaced from the guide pin 38. These equal upward forces cause upward displacement of the arm 30 against the urging of the springs 48 until the table support structure 14 attains a stable, static condition.

Once all four feet 32, 50 bear against the ground, the table 10 remains stable, as the arm 30, and therefore the feet 32, is effectively locked in position. This is because any attempt at rocking the table 10 will result in the application of unequal forces to the feet 32, causing automatic and immediate frictional locking of the arm 30, via the housing 36, on the guide pin 38.

Referring now to FIG. 6 of the drawings, reference numeral 80 generally indicates a portion of a stool or chair in accordance with the invention. The stool or chair 80 includes an upper- or seat portion, shown fragmentarily and indicated by reference numeral 82, mounted on a support assembly 14 in accordance with the invention. Thus, with the exception of the table top 12 being replaced with the seat portion 82, the stool or chair 80 is identical to and functions in similar fashion as the table 10, and accordingly is not described further.

It is an advantage of the invention as described with reference to the drawings, that the displaceable arm 30 and the guide pin 38 can be connected to a spider formation 18 used in the construction of conventional non-stabilizing table supports. This permits the manufacture of a stabilizing table, as described, without the need for large scale alterations to the machinery, such as dies or moulds, used to manufacture conventional tables. Furthermore, the guide pin 38 and displaceable leg 30 can be retro-fitted to existing tables, to form a self-stabilising table 10. Naturally the aforementioned also applies to stools or chairs. Yet further, the housing 36 enables the diameter of the guide passage 34 to be adjusted, in use, for optimal fit of the housing 36 around the guide pin 38.

The invention claimed is:

1. A support assembly for an item of furniture, the support assembly comprising:

an elongated support structure for connection at an operatively upper end thereof to an upper portion of an item of furniture, the support structure having a first pair of feet at or adjacent an operatively lower end thereof;

an elongated guide formation fast with the support structure and extending lengthwise relative to the support structure;

a displaceable support member including a second pair of feet at or adjacent an operatively lower end thereof, the displaceable support member being arranged relative to the support structure so that a line drawn between the feet of the first pair is transverse to a line drawn between the feet of the second pair, the displaceable support member also being provided with an elongated guided formation complementary to and longitudinally slidably engaged with the guide formation, so that the displaceable support member is slidably displaceable along a rectilinear guide path which is transverse to the lines drawn between both the pairs of feet, with one of the guide formation and the guided formation being in the form of a guide pin, the other one of the guide formation and the guided formation being in the form of a housing defining a guide passage within which the guide pin is longitudinally slidably received, the housing being constructed such that a cross-sectional area of the guide passage is adjustable, to permit dimensioning of the guide passage relative to the guide pin such that automatic frictional engagement of the guide pin with walls of the housing defining the guide passage occurs in response to pivoting of the displaceable support member about a pivot axis which is transverse to the displaceable support member's guide path, to anchor the displaceable support member frictionally against sliding displacement relative to the support structure;

wherein the housing is provided with a longitudinally extending slit and with an adjustment arrangement for adjusting the width of the slit, to permit said adjustability of the cross-sectional area of the guide passage;

wherein the adjustment arrangement comprises two passage defining formations and a bolt-and-nut assembly, one passage defining formation being located on each side of the slit, the passages defined by the formations being substantially aligned and extending transverse relative to a longitudinal axis of the guide passage, with the bolt of the assembly being received in and extending through the passages, such that the passage defining formations are held captive between the head of the bolt and the nut of the assembly, and adjustment of the width of the slit is effected by threading of the nut on the bolt;

wherein the guide passage is of circular cross-section, the guide pin being circular cylindrical;

wherein the guide formation is constituted by the guide pin, the guide pin projecting operatively downwardly from the operatively lower end of the support structure, and the guided formation being constituted by the guide passage defined by the housing, with the housing being centrally located with respect to the displaceable support member; and wherein the support structure comprises an elongated operatively upright post and a spider formation connected to an operatively lower end of the post, the spider formation comprising four radially outwardly projecting spokes which are equiangularly spaced about a longitudinal axis of the post, each spoke being channel-shaped and opening operatively downwardly, with the guide pin engaging the spider formation and projecting centrally operatively downwardly therefrom.

2. The support assembly as claimed in claim 1, wherein a first pair of aligned spokes is provided with the first pair of feet, the feet of the first pair respectively being provided at ends of the spokes of said one pair of spokes.

3. The support assembly as claimed in claim 2, wherein the displaceable support member comprises an arm which is received in the channel defined by a second pair of aligned spokes and extending lengthwise therealong, the feet of the second pair of feet respectively being provided at the ends of the arm.

4. The support assembly as claimed in claim 3, wherein the arm and the housing are integrally formed.

5. The support assembly as claimed in claim 4, further comprising at least one urging member urging the arm operatively downwardly away from the support structure.

6. The support assembly as claimed in claim 5, further comprising two urging members which are equally spaced on opposite sides of the guide formation, each urging member being in the form of a compressed spring located in the channel defined by said other pair of spokes and acting between the spokes and the arm.

7. The support assembly as claimed in claim 1, further comprising a securing formation fast with an operatively lower end of the guide pin, which securing formation together with the spider formation holds the housing captive on the guide pin.

8. The support assembly as claimed in claim 1 wherein the feet of the second pair are spaced at equal distances from a longitudinal axis of the guide formation.

9. The support assembly as claimed in claim 8, wherein the feet of the first pair are spaced the same distance from a longitudinal axis of the guide formation as the feet of the second pair are spaced from the longitudinal axis of the guide formation.

10. The support assembly as claimed in claim 1, wherein the line drawn between the first pair of feet and the line drawn between the second pair of feet are at right angles to each other.

11. The support assembly as claimed in claim 1, further comprising sealing means sealing the guide pin off from the environment.

12. A self-stabilizing arrangement for an item of furniture, the arrangement comprising:

an elongated first support component having at each end a foot projecting in the same direction;

an elongated guide formation fast with the first support component; and an elongated second support component having at each end a foot projecting in the same direction as the feet of the first support component, the second support component including an elongated guided formation complementary to and longitudinally slidably engaged with the guide formation, one of the guide formation and the guided formation being in the form of a guide pin, the other one of the guide formation and the guided formation being in the form of a guide passage defined by a housing fast with the associated one of the first and the second support components, within which guide passage the guide pin is longitudinally slidably received, such that the second support component is slidably displaceable relative to the first support component, with the housing being constructed such that a cross-sectional area of the guide passage is adjustable;

wherein the housing is provided with a longitudinally extending slit and with an adjustment arrangement for adjusting the width of the slit, to permit said adjustability of the cross-sectional are of the guide passage;

wherein the adjustment arrangement comprises two passage defining formations and a bolt-and-nut assembly, one passage defining formation being located on each side of the slit, the passages defined by the formations being substantially aligned and extending transverse to a longitudinal axis of the guide passage, with the bolt of the assembly being received in and extending through the passages, such that the passage defining formations are held captive between the head of the bolt and the nut of the assembly, and adjustment of the width of the slit is effected by threading of the nut on the bolt;

wherein the guide formation is constituted by the guide pin, the guide pin being centrally fast with the first support component and projecting in the same direction as the feet, the guided formation being constituted by the guide passage defined by the housing, the housing being integrally formed with and centrally located with respect to the second support component;

wherein the first support component and the second support component are orthogonal;

wherein the self-stabilizing arrangement includes a locating arrangement, the locating arrangement keeping the first and the second support components in a predetermined relative configuration; and wherein the locating arrangement includes a pair of longitudinally aligned spokes fast with the first support component and projecting radially outwardly therefrom, such that the spokes and the first support component are orthogonal, the spokes being shaped to define a locating channel opening in the same direction as the direction in which the feet and the pin project, in which locating channel the second support component is located.

13. The self-stabilizing arrangement as claimed in claim 12, wherein the guide formation and the guided formation are shaped and dimensioned such that there is limited clearance, which clearance is adjustable on account of the adjustability of the cross-sectional area of the guide passage, between the guide pin and a wall of the housing defining the guide passage, so that automatic frictional locking of the second support component relative to the first support component occurs when a nett moment about an axis transverse to a longitudinal axis of the guide pin is exerted on the second support component.

14. The self-stabilizing arrangement as claimed in claim 12, further comprising at least one urging member urging the second support component away from the first support component in the same direction in which the feet project.

15. The self-stabilizing arrangement as claimed in claim 12, further comprising two urging members which are equally spaced on opposite sides of the guide formation, each urging member being in the form of a compressed spring located in a channel defined by a second pair of spokes and acting between the spokes and the second support component.

16. The self-stabilizing arrangement as claimed in claim 12, further comprising a securing formation for securing it, in use, to a support structure of an item of furniture.

17. The self-stabilizing arrangement as claimed in claim 12, further comprising sealing means sealing the guide pin off from the environment.

18. The self-stabilizing arrangement as claimed in claim 12, further comprising a securing formation fast with the guide pin, which securing formation serves to hold the guided formation captive on the guide pin.

19. An item of furniture which includes a support assembly as claimed claim 1, and an upper portion of an item of furniture mounted on the support assembly.

20. The item of furniture as claimed in claim 19, which is a table, the upper portion of the item of furniture being a table top.

21. The item of furniture as claimed in claim 19, which is a stool or a chair, the upper portion of the item of furniture being a seat portion of the stool or chair.

22. An item of furniture which includes a self-stabilizing arrangement as claimed in claim 12, and an upper portion of an item of furniture fast with the first support component thereof.

23. An item of furniture as claimed in claim 22, which is a table, the upper portion of the item of furniture being a table top.

24. An item of furniture as claimed in claim 22, which is a stool or a chair, the upper portion of the item of furniture being a seat portion of the stool or chair.

* * * * *